United States Patent [19]

Kinsley

[11] Patent Number: 4,545,495

[45] Date of Patent: Oct. 8, 1985

[54] SNAP ACTION HINGE WITH CLOSED POSITION STRAIGHT STRAPS

[75] Inventor: John P. Kinsley, Crystal Lake, Ill.

[73] Assignee: Seaquist Valve Company, Cary, Ill.

[21] Appl. No.: 667,744

[22] Filed: Nov. 2, 1984

[51] Int. Cl.[4] ..... B65D 43/14

[52] U.S. Cl. ..... 215/235; 220/339; 222/517

[58] Field of Search ..... 215/235; 220/339, 335; 222/517

[56] References Cited

U.S. PATENT DOCUMENTS

| | | | |
|---|---|---|---|
| Re. 30,861 | 2/1982 | Krawagna | 16/293 |
| 3,289,877 | 12/1966 | Wolf . | |
| 3,628,215 | 12/1971 | Everburg . | |
| 3,741,447 | 6/1973 | Miles et al. | 222/517 |
| 3,752,371 | 8/1973 | Susuki et al. | 222/517 X |
| 4,403,712 | 9/1983 | Wiesinger | 220/339 |
| 4,457,458 | 7/1984 | Heinol et al. | 215/235 X |

FOREIGN PATENT DOCUMENTS

| | | | |
|---|---|---|---|
| 1056999 | 2/1967 | United Kingdom | 05001940/GBX |
| 521557 | 5/1940 | United Kingdom . | |

*Primary Examiner*—Donald F. Norton

*Attorney, Agent, or Firm*—Dressler, Goldsmith, Shore, Sutker & Milnamow, Ltd.

[57] ABSTRACT

A snap-action closure is provided with a body for being mounted on a container and with a cover hinged to the body. The closure includes two spaced-apart connecting elements. Each connecting element is joined to the body with a first hinge and to the cover with a second hinge so as to locate the connecting elements offset on one side of the main hinge axis when the cover is in the open position. Each connecting element has a generally linear configuration adjacent the cover and body when the cover is in the closed position and has a non-linear configuration lying generally in a plane parallel to the main hinge axis when the cover is in the open position.

21 Claims, 10 Drawing Figures

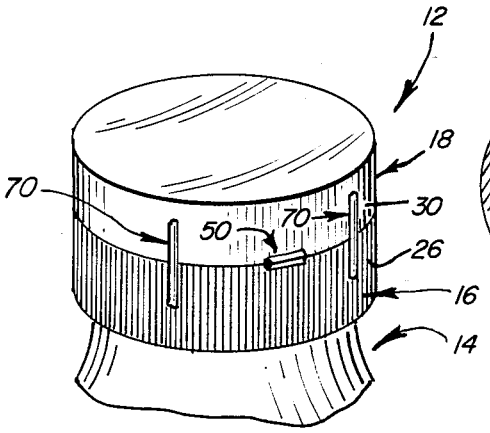
FIG. 1
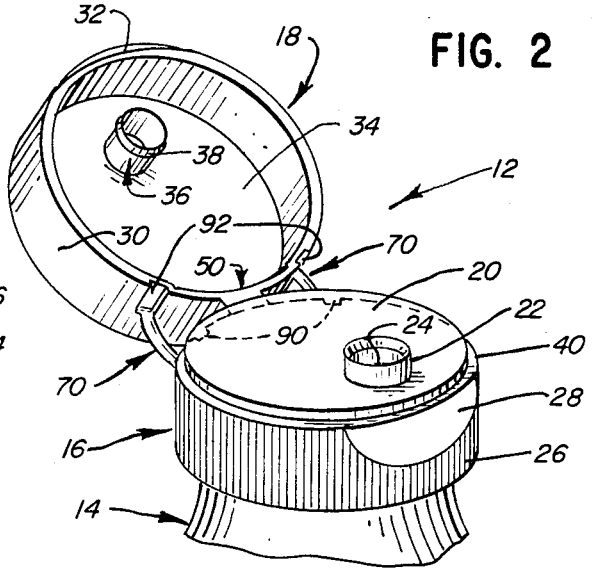
FIG. 2
FIG. 3
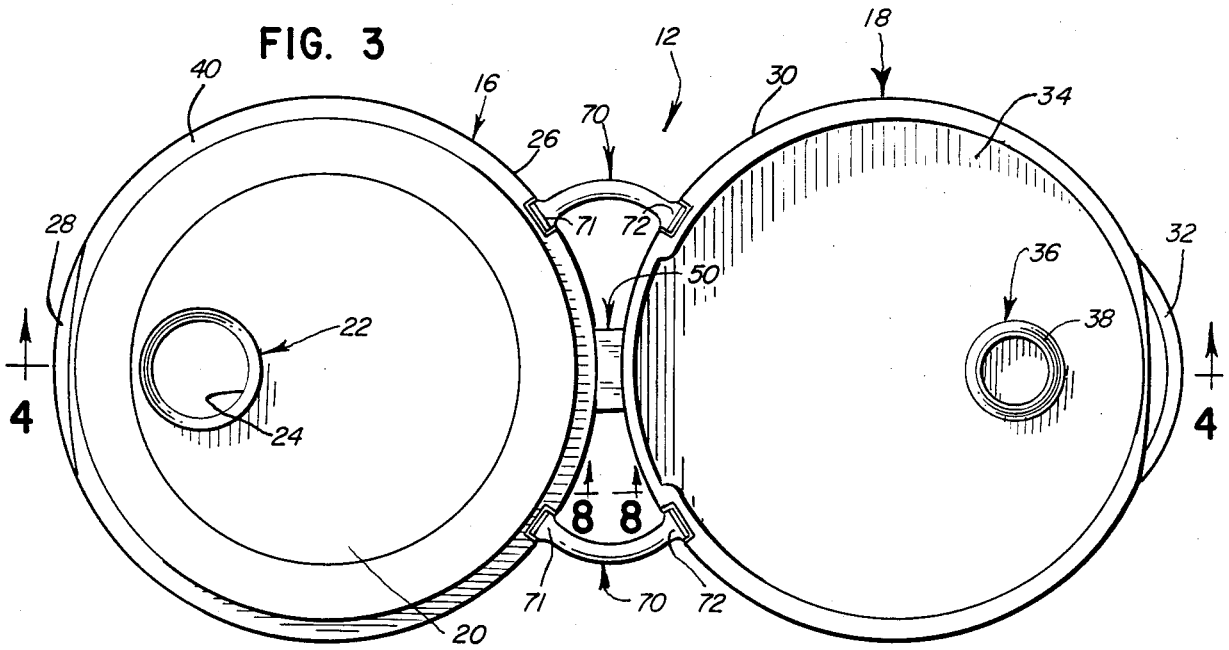
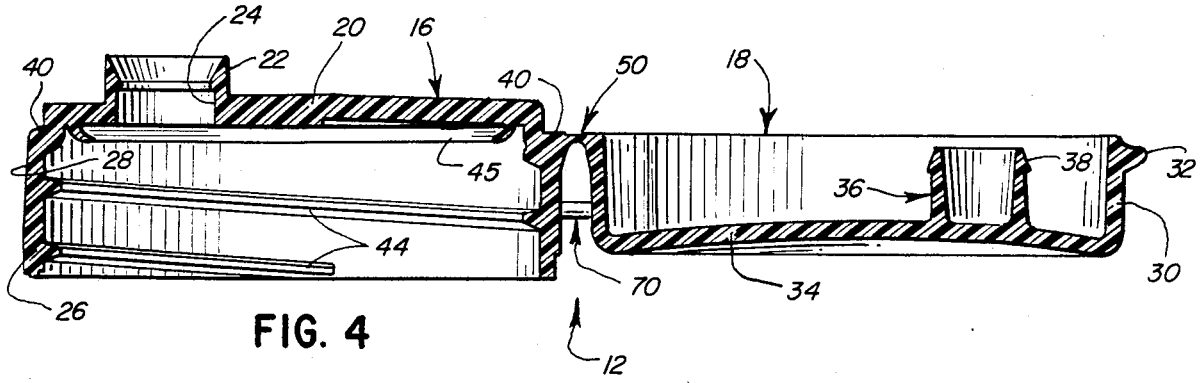
FIG. 4

FIG. 5
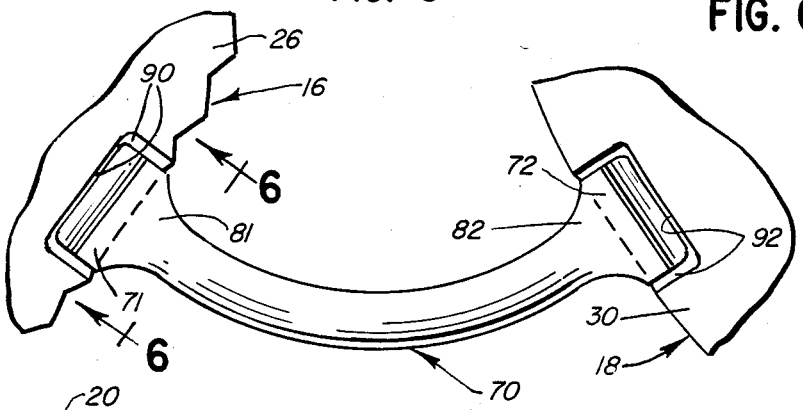
FIG. 6
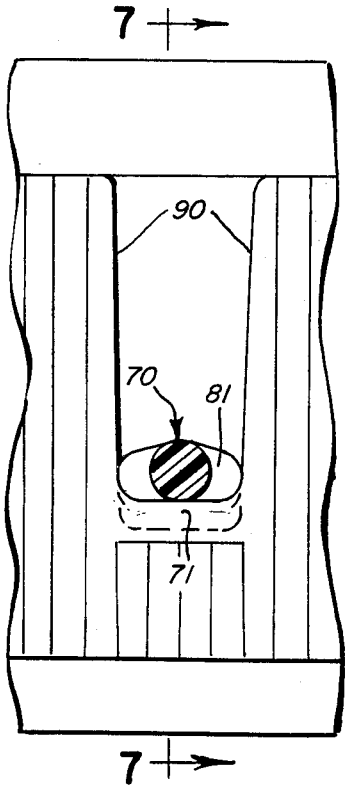
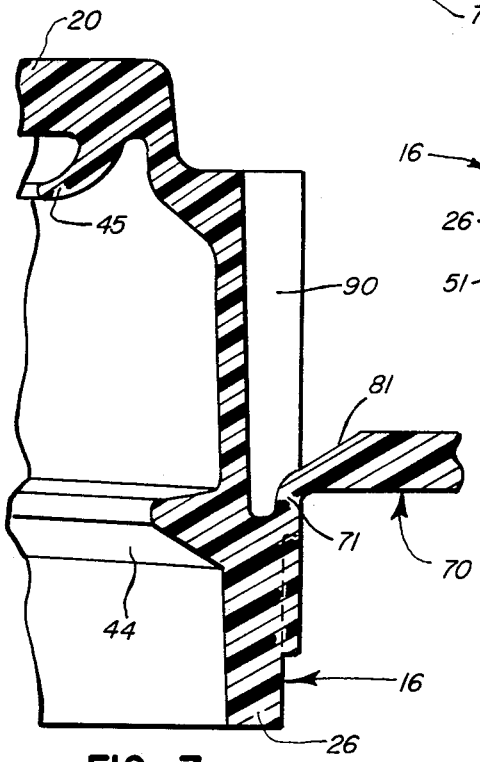
FIG. 7
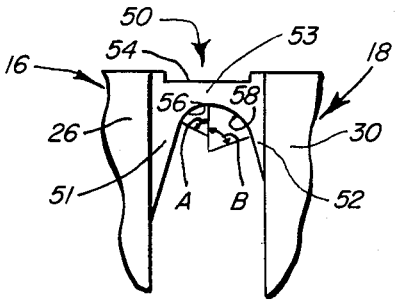
FIG. 8
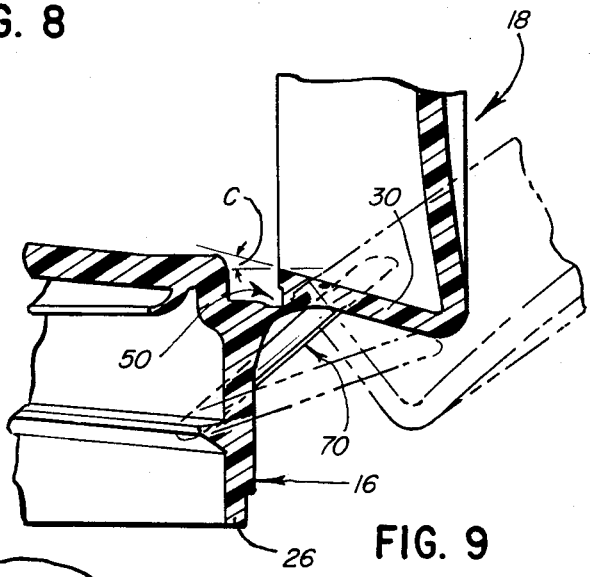
FIG. 9
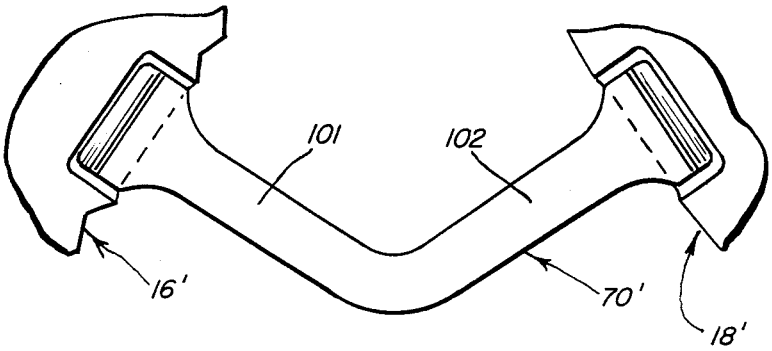
FIG. 10

SNAP ACTION HINGE WITH CLOSED POSITION STRAIGHT STRAPS

TECHNICAL FIELD

This invention relates to means for closing a container.

BACKGROUND OF THE INVENTION AND TECHNICAL PROBLEMS POSED BY THE PRIOR ART

Snap-action closures have been proposed for use on containers, and a number of such closures are commercially available today. Such closures typically include a base, collar, or body for being mounted on the container and for defining an opening into the container. Also, such a closure typically includes a lid, cap, or cover hingedly mounted to the base, collar, or body for movement between a closed position and an open position.

In conventional snap-action closures, the snap-action is provided through an arrangement of one or more main hinges and one or more offset connecting links. In some closures designs, the connecting links project or hang downwardly below the cover when the cover is in the open position. This can be aesthetically undesirable. Further, such a condition increases the exposure of the usually delicate connecting link to accidental, and possibly deleterious, interference or contact with exterior ambient objects.

Further, some conventional closures employ hinge and/or connecting link structures that define relatively large projections on the closure when the cover is in the closed position. This can interfere with the proper operation of certain types of conventional automatic closure-applying equipment. Further, such projections are frequently aesthetically undesirable.

Other conventional closure designs, in an attempt to reduce exterior projections, employ recessed structures and configurations. Such conventional closures typically require a relatively large amount of interior space to accommodate the recessed configuration. This tends to reduce the amount of usable internal volume in the closure and can effect the design of the interior portion of the closure structure that mounts on the container. Also, some closures with recessed configurations necessarily define or present concave openings in the exterior of the closure. These concave openings may communicate with the interior of the closure and can thus permit ingress of contaminants. Further, such concave openings may be aesthetically undesirable and/or act as sites for dirt accummulation.

Some designs for snap-action closures would appear to at least theoretically provide the desired snap-action operation. However, in practice, when such designs are incorporated in actual container closures fabricated from conventional materials, such as thermoplastic materials and the like, the operation of the closure is not entirely satisfactory. It has been found that some of these closures do not generate a snap-action that is as strong as would be desired.

It has also been found that some of these closures are relatively unstable and too flexible when the cover is in the open position. That is, the cover can too easily be twisted in one or more directions when it is in the open position and as it is moved to the closed position. When such closures are fabricated from conventional thermoplastic materials, the closure, during or after such cover twisting, may take on a temporary set that inhibits proper closing of the cover in precise registry with the body.

In view of the above-discussed problems with conventional snap-action closures, it would be desirable to provide an improved snap-action closure having increased resistance to twisting when the closure cover is in the open position.

Further, it would be desirable to provide such a closure with the capability for operating with a relatively forceful snap-action to insure complete and proper closing of the cover.

Also, it would be beneficial if such an improved closure employed a structure in which the connecting links would not project or hang downwardly below the cover when the cover is in the open position.

Finally, such an improved closure should advantageously have a configuration in the closed position that is substantially free of projections or features that might interfere with some types of conventional automatic capping machines. In this regard, a closure having substantially no interfering exterior projections should also have a configuration with a relatively large interior usable space. That is, it would be advantageous if the structures employed to effect the snap-action of the improved closure did not project too far inwardly so as to interfere with potential use of the interior region of the closure.

SUMMARY OF THE INVENTION

A resilient snap-action closure is provided for a container. The closure includes a body for being joined to the container and for defining a contents dispensing opening. The closure also includes a cover hinged to the body for pivoting movement about a main hinge axis between closed and open positions relative to the opening.

The closure further includes two spaced-apart connecting elements that are each joined to the body with a first hinge and to the cover with a second hinge so as to locate the connecting elements offset on one side of the main hinge axis when the cover is in the open position whereby the cover is held open. The closure deforms elastically as the cover is moved from the open position to the closed position about the main hinge axis until the closure snaps through a dead center position at which the closure is maximally deformed and beyond which both of the connecting elements are located on the other side of the main hinge axis where the deformation is at least partly reduced so that the cover is urged to the closed position.

Each connecting element has a generally linear configuration adjacent the cover and body when the cover is in the closed position. Each connecting element has a non-linear configuration lying generally in a plane parallel to the main hinge axis when the cover is in the open position.

Numerous other features and advantages of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of the closure of the present invention on a container body with the closure cover in the closed position;

FIG. 2 is a perspective view similar to FIG. 1, but with the container and closure rotated 180° from the FIG. 1 orientation and with the cover in the open position;

FIG. 3 is an enlarged plan view of the closure in a fully opened position as it may be formed from thermoplastic materials in a mold;

FIG. 4 is a cross-sectional view taken generally along the plane 4—4 in FIG. 3;

FIG. 5 is a greatly enlarged, fragmentary plan view of a portion of the fully opened closure shown in FIG. 3 to illustrate in more detail one of the connecting elements;

FIG. 6 is a cross-sectional view taken generally along the plane 6—6 in FIG. 5;

FIG. 7 is a fragmentary, cross-sectional view taken generally along the plane 7—7 in FIG. 6;

FIG. 8 is a greatly enlarged, fragmentary, elevational view taken generally along the plane 8—8 in FIG. 3;

FIG. 9 is a fragmentary, enlarged, cross-sectional view similar to FIG. 4 but showing a normal open position of the cover in dashed lines and showing an intermediate position of the cover in solid lines; and FIG. 10 is a view similar to FIG. 5, but showing an alternate embodiment of a connecting element.

DESCRIPTION OF THE PREFERRED EMBODIMENTS

While this invention is susceptible of embodiment in many different forms, this application and the accompanying drawings disclose only some specific forms as examples of the use of the invention. The invention is not intended to be limited to the embodiments so described, and the scope of the invention will be pointed out in the appended claims.

For ease of description, the closure of this invention is described in use on a container, or as part of a container, with the container being oriented in a normal (upright) position. Terms such as upper, lower, horizontal, etc., are used with reference to this position. It will be understood, however, that the closure of this invention may be manufactured, stored, transported, used, and sold in an orientation other than the position described.

A first embodiment of the closure of the present invention is illustrated in FIG. 1 wherein the closure is represented generally by the reference numeral 12. The closure 12 is shown in FIG. 1 as being mounted on a container 14. The closure 12 includes a collar, base, or body 16 for being joined to the container 14, either in a unitary manner or by other removable or non-removable means (e.g., threading engagement, snap-on engagement, bonding by means of adhesive or welding, etc.).

The closure 12 includes a cover, cap, or lid 18 adapted to be disposed upon the body 16. The cover 18 is shown on top of the body 16 in a closed position in FIG. 1 and in an open position in FIG. 2.

The interior structure of the closure 12 illustrated in FIG. 2 may vary depending upon the type of container 14, upon the type of contents to be dispensed from the container 14, and upon the dispensing action that is desired. One specific interior configuration is shown in the Figures for illustrative purposes only.

The closure body 16 has a generally flat closure end portion or cross wall 20 with a generally cylindrical discharge spout 22 defining an opening 24 for dispensing the contents of the container 14. The body 16 includes a skirt 26 which defines at least a partially cylindrical portion of the closure 12. In the illustrated first embodiment, the skirt 26 is generally cylindrical but includes an undercut, angled thumb-notch surface 28.

The cover 18 is movable between the closed position on the container 14 (as shown in FIG. 1) for engaging the body 16 to close off the body opening 24 and the open position (as shown in FIG. 2) spaced from the body opening 24. The cover 18 defines at least a partially cylindrical portion or skirt 30. In the embodiment illustrated in FIGS. 1–9, the skirt 30 is generally cylindrical with an outwardly projecting thumb tab 32 which overlies the body thumb-notch 28 when the cover 18 is in the closed position.

In the first embodiment illustrated in FIGS. 1–9, the cover 18 also includes an end cross-wall 34 at the upper end of the cylindrical skirt 30. On the inside of the cover 18, projecting from the cross wall 34, is a spud 36 which is a hollow, generally cylindrical member for entering into the opening 24 in the spout 22 of the body 16. The spud 36 preferably has a frustoconical surface 38 for guiding the spud 36 into the spout 22.

In the preferred embodiment illustrated in FIGS. 1–9, it is intended that the cover 18 close in general registry on top of the body 16. To help maintain such registration when the cover 18 is in the closed position, the body 16 defines an annular shoulder 40 below the body cross wall 20. The bottom edge of the cover skirt 30 is received on the shoulder 40 with the body cross wall 20 projecting upwardly within the skirt 30.

In the first embodiment illustrated in FIGS. 1–9, the closure body 16 is adapted to be threaded onto the neck of the container 14. To this end, the interior of the body cylindrical skirt 26 is provided with conventional threads 44. The threads 44 are adapted to engage suitable mating threads on the neck of the container 14.

The underside of the body cross wall 20 of the body 16 may be provided with an annular seal 45 (FIG. 4) for sealing against the top of the container 14 when full threading engagement has been achieved.

The cover 18 is hinged to the body 16 for pivoting movement about a main hinge axis defined by a main hinge 50. As best illustrated in FIG. 8, the main hinge 50 is a member having a first portion 51 joined to the body 16 and having a second portion 52 joined to the cover 18. The main hinge first portion 51 is larger than the main hinge second portion 52 and is joined to the main hinge second portion 52 in a unitary structure with a film hinge 53.

The main hinge first portion 51 slopes outwardly from the body 16 to the film hinge 53. The main hinge second portion 52 slopes outwardly from the cover 18 to the film hinge 53. The length of the slope of the main hinge first portion 51 is greater than the length of the slope of the main hinge second portion 52.

If the closure 12 is molded from a thermoplastic material in the full open position as illustrated in FIGS. 3, 4 and 8, then the structure of the main hinge 50 can be further defined with reference to its shape in such an "as molded" full open position. Specifically, with reference to FIG. 8, the film hinge 53 of the main hinge 50 defines a recessed, generally planer surface 54 on the exposed interior region of the closure 12. On the exterior region of the closure 12, the film hinge 53 is defined in part by a first partially cylindrical surface 56 which merges with the main hinge first portion 51. Also, the film hinge 53 is defined in part on the exterior region of the closure by a second partially cylindrical surface 58 which merges with the main hinge second portion 52 and with the first partially cylindrical surface 56.

The radius of curvature of the first partially cylindrical surface 56 is less than the radius of curvature of the second partially cylindrical surface 58. The first partially cylindrical surface 56 defines an arc which subtends an angle A as illustrated in FIG. 8. The second partially cylindrical surface 58 defines an arc which subtends an angle B as illustrated in FIG. 8.

In one particular closure that has been proposed in accordance with the present invention, the radius of curvature of the arc defined by the first partially cylindrical surface 56 is about 0.02", and the radius of curvature of the second partially cylindrical surface 58 is about 0.03". The length of the recessed planar surface 54 is about 0.06". The planar surface 54 is recessed to a depth of about 0.005". The thickness of the film hinge 53 measured through a plane perpendicular to, and bisecting, the surface 54 is about 0.015" with the surfaces of the hinge first portion 51 and hinge second portion 52 each being oriented at an angle of about 15° relative to the bisecting plane.

A pair of spaced-apart, somewhat stiff straps or connecting elements 70 are provided on opposite ends of the main hinge 50. Each connecting element 70 is connected to the cylindrical skirt 26 of the body 16 with a first hinge 71 and to the cylindrical skirt 30 of the cover 18 with a second hinge 72. According to one preferred construction, the closure of the present invention may be molded from a thermoplastic material, and each connecting element hinge 71 and 72, as well as the main hinge 50, may be a "living" film hinge.

In the preferred embodiment illustrated in FIGS. 1–9, and as best shown in FIGS. 5 and 6, the major portion of the length of each connecting element 70 has generally circular transverse cross-section. Each element 70 has a first end portion 81 (FIG. 5) at the first hinge 71 that is generally perpendicular to the axis of the first hinge 71. Similarly, each connecting element 70 has a second end portion 82 (FIG. 5) that is generally perpendicular to the axis of the second hinge 72. The end portions 81 and 82 each flare outwardly to a width that is greater than twice the diameter of the circular transverse cross-section of the connecting element 70.

Each connecting element 70 has a generally elongate configuration. When the closure cover 18 is in the open position, each connecting element 70 has a non-linear configuration, such as the generally curved configuration illustrated in FIGS. 3 and 5, which lies generally in a plane parallel to the main hinge axis.

According to a preferred form of fabricating the closure 12 of the present invention, the closure 12 is molded from polypropylene with the cover 18 in a full open position (as illustrated in FIGS. 3 and 4) with each connecting element 70 being formed in an arcuate, elongate configuration. Preferably, the molding is effected to produce an orientation of the macromolecular chains of polypropylene along the length of each connecting element 70. This provides a relatively strong structure with respect to withstanding forces that are applied to the ends of the connecting elements 70 in directions generally perpendicular to the connecting element hinges 71 and 72.

In a specific size closure made in accordance with the teachings of the present invention, the diameter of the circular transverse cross-section of each connecting element 70 is about 0.038", and each connecting element 70 maintains a generally circular arc configuration when the cover is in the open position. The inner arc radius of each element 70 is about 0.216". Such a closure may be molded in the open position with the center of the connecting element circular arc lying in a first plane that (1) contains the axis of the main hinge 50 and (2) is generally perpendicular to a second plane containing both connecting elements 70 in the molded full open position (FIGS. 3 and 4).

A unique structure is provided for reducing, if not substantially eliminating altogether, exterior projections on the closure. Specifically, each connecting element 70 is adapted to be received within the cylindrical skirt portions of the closure body 16 and closure cover 18. This is best illustrated in FIGS. 1, 2, and 5–7. The body 16 defines two spaced-apart channels 90 at opposite ends of the main hinge 50. Similarly, the cover 18 defines two spaced-apart channels 92 at opposite ends of the main hinge 50. On each end of the main hinge 50 one of the cover channels 92 and one of the body channels 90 are in end-to-end registry when the cover 18 is in the closed position so as to define a recess for receiving one of the connecting elements 70.

The closure 12 is elastically deformable as the cover 18 is moved from the open position to the closed position about the axis of the main hinge 50. In the preferred embodiment illustrated in FIGS. 1–9, the cylindrical skirt 30 of the cover 18 is elastically deformable or resilient, at least in the region adjacent the main hinge 50. Specifically, with reference to FIG. 9, it can be seen that as the cover 18 moves from the open position (illustrated in dashed lines) toward the closed position, the cylindrical skirt 30 near the hinge 50 bends inwardly somewhat. This is because the connecting elements 70 are offset on one side of the axis of the main hinge 50 when the cover 18 is in the open position (as shown in dashed lines) and become located on the other side of the axis of the main hinge 50 as the closure snaps through the dead center position.

The solid lines in FIG. 9 illustrate the approximate dead center position of the closure 12 wherein the closure cover 18 is maximally deformed. The deformation of the cylindrical skirt 30 of the cover 18 can be seen in FIG. 9 as an inward bending of the skirt 30 through an angle C relative to a line generally perpendicular to the plane defining the bottom edge of the skirt 30.

As the cover 18 is moved from the open position to the dead center position, the connecting elements 70 begin to straighten out from the non-linear configuration to a substantially straight or linear configuration. As the cover 18 continues toward the closed position, the connecting elements 70 remain substantially straight and ultimately lie adjacent the body 16 and cover 18 when the closure is fully closed. To this end, the recesses 90 in the body 16 and the recesses 92 in the cover 18 function to receive the straightened connecting elements 70. Thus, the connecting elements 70 do not project beyond the exterior surface of the closure in the closed position. In the fully closed position, the connecting elements 70 may be characterized as having a generally linear configuration adjacent the body 16 and closed cover 18.

When a closure 12 of the present invention is fabricated by molding a thermoplastic material, the closure 12 may preferably be molded in a completely open position as illustrated in FIGS. 3 and 4. In this open position the cover 18 is disposed at a substantially 180° angle relative the body 16 as measured about a vertex defined the main hinge axis.

With typical thermoplastic materials used for the closure fabrication, such as polypropylene, the cover 18 initially maintains the fully opened position illustrated in FIG. 4 after the closure is removed from the mold. However, after the cover 18 is closed once or twice the cover 18 will not thereafter assume the fully opened position illustrated in FIG. 4. Typically, some degree of permanent deformation occurs in the closure structure when it is first closed, and the cover 18 will then typically reopen to an orientation somewhat less than 180° from the body 16. Such a "reopen" or "normal open" orientation is illustrated in FIG. 2. Clearly, the cover 18 is still pivoted a sufficient amount relative to the body 16 to provide the desired access to the body opening 24.

It can be seen that when the cover 18 is in the open position (either the molded full open position illustrated in FIG. 4 or the reopen position illustrated in FIG. 2), both connecting elements 70 have a non-linear configuration lying generally in a common plane parallel to the axis of the main hinge 50. The connecting elements 70 are sufficiently rigid so as to maintain the generally non-linear configuration when the cover 18 is in the self-maintained open position. However, it is not necessary that each connecting element 70 have an arcuate configuration in the open position. Non-arcuate configurations may be provided as will next be explained.

FIG. 10 shows an alternate embodiment in which a connecting element 70' is provided between a body 16' and a cover 18'. The connecting element 70' has an angled configuration when the closure is in the open position. Specifically, the connecting element 70' has a first straight portion 101 adjacent the body 16' and a second straight portion 102 adjacent the cover 18'.

The second straight portion 102 is oriented at an angle relative to the first straight portion 101 when the closure is in the open orientation. When the cover 18' is moved to the closed position, the connecting element 70' straightens out into a generally linear configuration adjacent the closed body and cover.

It has been found that the novel non-linear open configuration of the connecting elements 70 (70') provides for an improved snap-action operation. It is also believed that the non-linear configuration of each connecting element in the open position reduces, or at least makes more uniform, the stresses at the film hinge at each end of each connecting element.

When a closure of the present invention is molded from polypropylene, it has been found to have a relatively high snap-action operating force. Further, such a closure has been found to be relatively stable and resistant to twisting or deformation in the open position, as well as during closing of the closure. Accordingly, better closing action with improved registry results when using the closure of the present invention.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A resilient snap-action closure for a container, said closure comprising:

a body for being joined to said container and defining an opening for dispensing the contents of said container, said body including at least a first convexly curved exterior portion;

a cover movable between a closed position on said container for engaging said body to close off said body opening and an open position spaced from said body opening, said cover including at least a second convexly curved exterior portion adapted to lie adjacent and in registry with said first convexly curved exterior portion when said cover is in said closed position;

a main hinge means for hingedly connecting said convexly curved exterior portions of said body and cover along a main hinge axis; and two spaced-apart connecting elements, each said connecting element being joined to said body first curved exterior portion with a first hinge and being joined to said cover second curved exterior portion with a second hinge so as to locate said connecting elements offset on one side of said main hinge axis when said cover is in said open position whereby said cover is held open, the closure deforming elastically as said cover is moved from said open position to said closed position about said main hinge axis until said closure snaps through a dead center position at which said closure is maximally deformed and beyond which both of said connecting elements are located on the other side of said main hinge axis where the deformation is at least partly reduced so that said cover is urged to said closed position, said connecting elements lying on opposite ends of said main hinge means, each said connecting element having a generally linear configuration adjacent said first and second curved exterior portions when said cover is in said closed position and having a non-linear configuration lying generally in a plane parallel to said main hinge axis when said cover is in said open position.

2. The closure in accordance with claim 1 in which said closure body includes a generally cylindrical skirt for being threadingly engaged with said container.

3. The closure in accordance with claim 1 in which said closure body and cover are each generally cylindrical.

4. The closure in accordance with claim 1 in which said closure is molded from a thermoplastic material, in which said main hinge means is a film hinge, and in which each of said first and second hinges is a film hinge.

5. The closure in accordance with claim 4 in which said material is polypropylene and in which said closure is injection molded with each said connecting element having an elongate configuration and an orientation of the macromolecular chains along the length of the connecting element.

6. The closure in accordance with claim 1 in which both of said connecting elements lie generally in a single common plane parallel to said main hinge axis when said cover is in said closed position.

7. The closure in accordance with claim 1 in which at least a part of said cover first convexly curved exterior portion is elastically deformable adjacent said main hinge means.

8. A resilient snap-action closure for a container, said closure comprising:

a body for being joined to said container and defining an opening for dispensing the contents of said container, said body including a collar defining at least a partially cylindrical portion;

a cover movable between a closed position on said container for engaging said body to close off said body opening and an open position spaced from said body opening, said cover defining at least a partially cylindrical portion adapted to be disposed adjacent said body cylindrical portion when said cover is in said closed position;

main hinge means for hingedly connecting said cylindrical portions of said body and cover along a main hinge axis;

a pair of connecting elements on opposite ends of said main hinge means for each connecting said body with said cover, each said connecting element being connected to said cylindrical portion of said body with a first hinge and to said cylindrical portion of said cover with a second hinge;

said body cylindrical portion defining a pair of channels located on opposite ends of said main hinge means, said cover cylindrical portion defining a pair of channels located on opposite ends of said main hinge means, each said body channel being in registry with one of said cover channels when said cover is in said closed position to define a recess for receiving one of said connecting elements;

each said connecting element lying in a generally straight line in one of said recesses when said cover is in said closed position and lying in a non-linear configuration in a plane generally parallel to said main hinge axis when said cover is in said open position; and said connecting elements being offset on one side of said main hinge axis when said cover is in said open position whereby said cover is held open, the closure deforming elastically as said cover is moved from said open position to said closed position about said main hinge axis until said closure snaps through a dead center position at which said closure is maximally deformed and beyond which both of said connecting elements are located on the other side of said main hinge axis where the deformation is at least partly reduced so that said cover is urged to said closed position.

9. A resilient snap-action closure for a container, said closure comprising:

a body for being joined to said container and defining a contents dispensing opening;

a cover hinged to said body for pivoting movement about a main hinge axis between closed and open positions relative to said opening; and two spaced-apart connecting elements, each said connecting element being joined to said body with a first hinge and to said cover with a second hinge so as to locate said connecting elements offset on one side of said main hinge axis when said cover is in said open position whereby said cover is held open, the closure deforming elastically as the cover is moved from said open position to said closed position about said main hinge axis until said closure snaps through a dead center position at which said closure is maximally deformed and beyond which both of said connecting elements are located on the other side of said main hinge axis where the deformation is at least partly reduced so that said cover is urged to said closed position, and each said connecting element having a generally linear configuration adjacent said cover and body when said cover is in said closed position and having a non-linear configuration lying generally in a plane parallel to said main hinge axis when said cover is in said open position.

10. The closure in accordance with claim 9 in which both of said connecting elements lie generally in a single common plane parallel to said main hinge axis when said cover is in said open position.

11. The closure in accordance with claim 10 in which each said connecting element is sufficiently rigid to maintain a generally arcuate configuration when said cover is in said open position.

12. The closure in accordance with claim 11 in which each said connecting element maintains a generally circular arc configuration when said cover is in said open position and in which the center of the circular arc configuration lies in a plane that contains said main hinge axis and that is perpendicular to said single common plane.

13. The closure in accordance with claim 9 in which said closure is injection molded from polypropylene with said cover in said open position and in which each said connecting element has an arcuate, elongate configuration and an orientation of the macromolecular chains along the length of the connecting element.

14. The closure in accordance with claim 9 in which a major portion of the length of each said connecting element has a generally circular transverse cross section.

15. The closure in accordance with claim 9 in which each said connecting element has a first end portion at said first hinge that is generally perpendicular to the axis of said first hinge and in which each said connecting element has a second end portion at said second hinge that is generally perpendicular to the axis of said second hinge.

16. The closure in accordance with claim 15 in which a major portion of the length of each said connecting element has a generally circular transverse cross section and in which each of said first and second end portions of each said connecting element flares outwardly to a width that is greater than twice the diameter of said circular transverse cross section.

17. The closure in accordance with claim 9 in which said closure includes a main hinge between said connecting elements for joining said cover and body along said main hinge axis, in which said cover defines two spaced-apart channels at opposite ends of said main hinge, in which said body defines two spaced-apart channels at opposite ends of said main hinge, in which one of said cover channels and one of said body channels at one end of said main hinge are in end-to-end registry when said cover is in said closed position so as to define a recess for receiving one of said connecting elements, and in which the other of said cover channels and the other of said body channels at the other end of said main hinge are in end-to-end registry when said cover is in said closed position so as to define a recess for receiving the other of said connecting elements.

18. The closure in accordance with claim 9 in which a part of said cover adjacent said main hinge axis is elastically deformable.

19. The closure in accordance with claim 9 in which said closure includes a main hinge between said connecting elements for joining said cover and body along said main hinge axis, in which said main hinge includes a member having a first portion joined to said body and a second portion joined to said cover, said main hinge first portion being larger than said main hinge second portion and being joined to said second main hinge portion in a unitary structure with a film hinge.

20. The closure in accordance with claim 19 in which said main hinge first portion slopes outwardly from said body to said film hinge, in which said main hinge second portion slopes outwardly from said cover to said film hinge, and in which the length of said slope of said main hinge first portion is greater than the length of said slope of said main hinge second portion.

21. The closure in accordance with claim 20 in which said main hinge film hinge is defined, when said cover is in said open position, on the exposed interior region of the closure by a generally planar surface and on the exterior region of the closure by (1) a first partially cylindrical surface merging with said main hinge first portion and (2) a second partially cylindrical surface merging with said main hinge second portion and with said first partially cylindrical surface, the radius of curvature of said first partially cylindrical surface being less than the radius of curvature of said second partially cylindrical surface.

* * * * *